US010955135B2

(12) United States Patent
Ferguson et al.

(10) Patent No.: US 10,955,135 B2
(45) Date of Patent: Mar. 23, 2021

(54) BURNER PANEL FOR A METALLURGICAL FURNACE

(71) Applicant: Systems Spray-Cooled, Inc, Smyrna, TN (US)

(72) Inventors: Scott A. Ferguson, Murfreesboro, TN (US); Troy D. Ward, Franklin, TN (US); Eric Chodl, Smyrna, TN (US); Ron Coursey, Smyrna, TN (US)

(73) Assignee: Systems Spray-Cooled, Inc., Smyrna, TN (US)

( * ) Notice: Subject to any disclaimer, the term of this patent is extended or adjusted under 35 U.S.C. 154(b) by 124 days.

(21) Appl. No.: 16/011,618

(22) Filed: Jun. 18, 2018

(65) Prior Publication Data

US 2019/0383484 A1 Dec. 19, 2019

(51) Int. Cl.

| | |
|---|---|
| ***F27D 1/12*** | (2006.01) |
| ***F23D 14/78*** | (2006.01) |
| ***F27B 3/20*** | (2006.01) |
| ***F23C 5/02*** | (2006.01) |
| ***F23M 5/02*** | (2006.01) |
| *F27D 99/00* | (2010.01) |

(52) U.S. Cl.

CPC ..... *F23D 14/78* (2013.01); *F23C 5/02* (2013.01); *F23M 5/025* (2013.01); *F27B 3/205* (2013.01); *F27D 1/12* (2013.01); *F27D 99/0005* (2013.01); *F27D 99/0033* (2013.01)

(58) Field of Classification Search

CPC ..... F23C 3/004; F23D 14/22

See application file for complete search history.

(56) References Cited

U.S. PATENT DOCUMENTS

| | | | | |
|---|---|---|---|---|
| 3,480,375 | A | 11/1969 | Sitte | |
| 4,437,415 | A * | 3/1984 | Spielman | F23M 5/085 110/180 |
| 8,277,721 | B2 | 10/2012 | Shyer | |
| 2003/0075843 | A1 | 4/2003 | Wunsche | |
| 2013/0032978 | A1 | 2/2013 | Glass | |
| 2017/0059154 | A1 * | 3/2017 | Luka | C03B 5/1675 |

FOREIGN PATENT DOCUMENTS

| | | | |
|---|---|---|---|
| JP | H10267541 | A | 10/1998 |
| JP | 2003322313 | A | 11/2003 |

OTHER PUBLICATIONS

International Search Report and Written Opnion from PCT/US2019/037462 dated Oct. 2, 2019.

* cited by examiner

*Primary Examiner* — Scott R Kastler

(74) *Attorney, Agent, or Firm* — Patterson + Sheridan, LLP

(57) ABSTRACT

One or more embodiments of a burner panel for a metallurgical furnace is described herein. One or more embodiments of a burner panel for a metallurgical furnace are described herein. The sidewall burner pockets have a burner panel therein. The burner panel has a body having an interior face with burner tube disposed therethrough. The burner tube has a first portion and a second portion coupled to the first portion. The burner panel additionally has an internal mounting flange extending along the periphery of the body and overlapping the sidewall, the sidewall and internal mounting flange compressed together by a coupling.

20 Claims, 13 Drawing Sheets

BURNER PANEL FOR A METALLURGICAL FURNACE

BACKGROUND OF THE DISCLOSURE

Field of the Disclosure

Embodiments of the present disclosure relates generally to a burner panel for a metallurgical furnace, and a metallurgical furnace having the same.

Description of the Related Art

Metallurgical furnaces (e.g., electric arc furnaces, ladle metallurgical furnaces and the like) are used in the processing of molten metal materials. The electric arc furnace heats charged metal in the furnace by means of an electric arc from a graphite electrode and/or one or more oxy-fuel burners. The heating from both the electric current from the electrode passing through the charged metal material and the oxy-fuel burners form a molten bath of metal material. Melting of the metal material also forms slag (a stony waste material).

A metallurgical furnace has number of components, including a roof that is retractable, a hearth that is lined with refractory brick, and a sidewall that sits on top of the hearth. The metallurgical furnace typically rests on a tilting platform to enable the furnace to tilt about an axis. During the processing of molten materials, the furnace tilts in a first direction to remove slag through a first opening in the furnace referred to as the slag door. Tilting the furnace in the first direction is commonly referred to as "tilting to slag." The furnace must also tilt in a second direction during the processing of molten materials to remove liquid steel via a tap spout. Tilting the furnace in the second direction is commonly referred to as "tilting to tap." The second direction is generally in a direction substantially opposite the first direction.

Because of the extreme heat loads generated during the processing of molten materials within the metallurgical furnace, various types of cooling methods are used to regulate the temperature of, for example, the roof and sidewall of the furnace. One cooling method, referred to as non-pressurized spray-cooling, sprays a fluid-based coolant (e.g., water) against an external surface of plate that comprises the roof, sidewall or other hot surface of the furnace. For this cooling method, the fluid-based coolant is sprayed from a fluid distribution outlet at atmospheric pressure. As the fluid-based coolant contacts the external surface of the plate, the plate is relieved of heat transferred to the plate from the molten materials within the furnace, thus regulating the temperature of the plate. An evacuation system is used to continually remove spent coolant (i.e., coolant that has contacted the external surface of the plate) from the plate.

The typical oxy-fuel burners and injectors disposed through a sidewall of the furnace are housed of a separate large copper burner panel with openings to house the burner/injector. The burner panels typically have internal high-pressure cooling pipes to withstand the heat of the furnace and potential blowback from the burner itself. The cooling system for the burner panel is plumbed to an external cooling system separate than that of the furnace. Conventional copper burner panels having tubular water cooling have been manufactured for years in varying different shapes. Some nearly flush with the inside diameter of the sidewall others protruding out into the furnace. The conventional burner panels having the tubular water cooling are formed from a large unitary mass of material for heat transfer and cooling purposes.

The intense heat and harsh environment of which the burner panel is exposed to, along with the complex cooling and draining system for the furnace, necessitates periodic maintenance and refurbishment of the burner panels for the electric arc furnace. The burner panels are typically mechanically fixed in place so as to seal openings formed in the sidewall of the furnace. Furthermore, due to the weight, size and complexity of the oxy-fuel burners and the burner panels, it is difficult and expensive to remove, repair and replace the burner panels. Thus, the cost of maintaining the burner panels, coupled with the assembly and disassembly time, can become expensive and labor intensive.

Therefore, there is a need for an improved burner panel, and furnace having the same.

SUMMARY

One or more embodiments of a burner panel for a metallurgical furnace are described herein. The sidewall burner pockets have a burner panel therein. The burner panel has a body having an interior face with burner tube disposed therethrough. The burner tube has a first portion and a second portion coupled to the first portion. The burner panel additionally has an internal mounting flange extending along the periphery of the body wherein the body of the burner panel has no additional holes or plumbing for cooling.

In yet another example, a metallurgical furnace having a burner panel is described herein. The metallurgical furnace has a sidewall having a roof disposed thereon. The sidewall has an interior face and a plurality of sidewall burner pockets. The sidewall burner pockets have a burner panel therein. The burner panel has a body having an interior face with burner tube disposed therethrough. The burner tube has a first portion and a second portion coupled to the first portion. The burner panel additionally has an internal mounting flange extending along the periphery of the body and overlapping the sidewall, the sidewall and internal mounting flange compressed together by a coupling.

In yet another example, a method of securing a burner panel to a metallurgical furnace is described herein. The method starts by placing a mounting flange of a burner panel over an interior wall of the metallurgical furnace. The method continues by compressing the flange and wall together to form a fluid seal therebetween.

BRIEF DESCRIPTION OF THE DRAWINGS

So that the way the above recited features of the present disclosure can be understood in detail, a more particular description of the disclosure, briefly summarized above, may be had by reference to embodiments, some of which are illustrated in the appended drawings. It is to be noted, however, that the appended drawings illustrate only typical embodiments of this disclosure and are therefore not to be considered limiting of its scope, for the disclosure may admit to other equally effective embodiments.

DETAILED DESCRIPTION

The present invention is directed to a metallurgical furnace having one or more burner panels therein for melting metal material. The furnace includes a plate having one side that faces an interior portion of the furnace in which the metal is melted. The plate may be part of a sidewall, roof or other portion of the furnace. In one embodiment, the burner panel is formed from a mass of copper having an integral carbon steel frame that enables welding of the frame to the carbon steel material comprising the plate, thus, providing a water-tight seal between the burner panel and the plate. The copper mass may include provisions to house an oxy-fuel burner and/or oxygen injector and/or carbon injector. The integral copper mass is water-cooled utilizing non-pressurized spray cooling system that also cools the plate by spraying a fluid-based coolant, such as water, against an external surface to relieve heat load generated by the melting processes ongoing within the furnace. The integral design of the cooling system eliminates the need for a separate independent high-pressure cooling piping system and corresponding drain piping system for cooling the burner panel.

Figure 1:
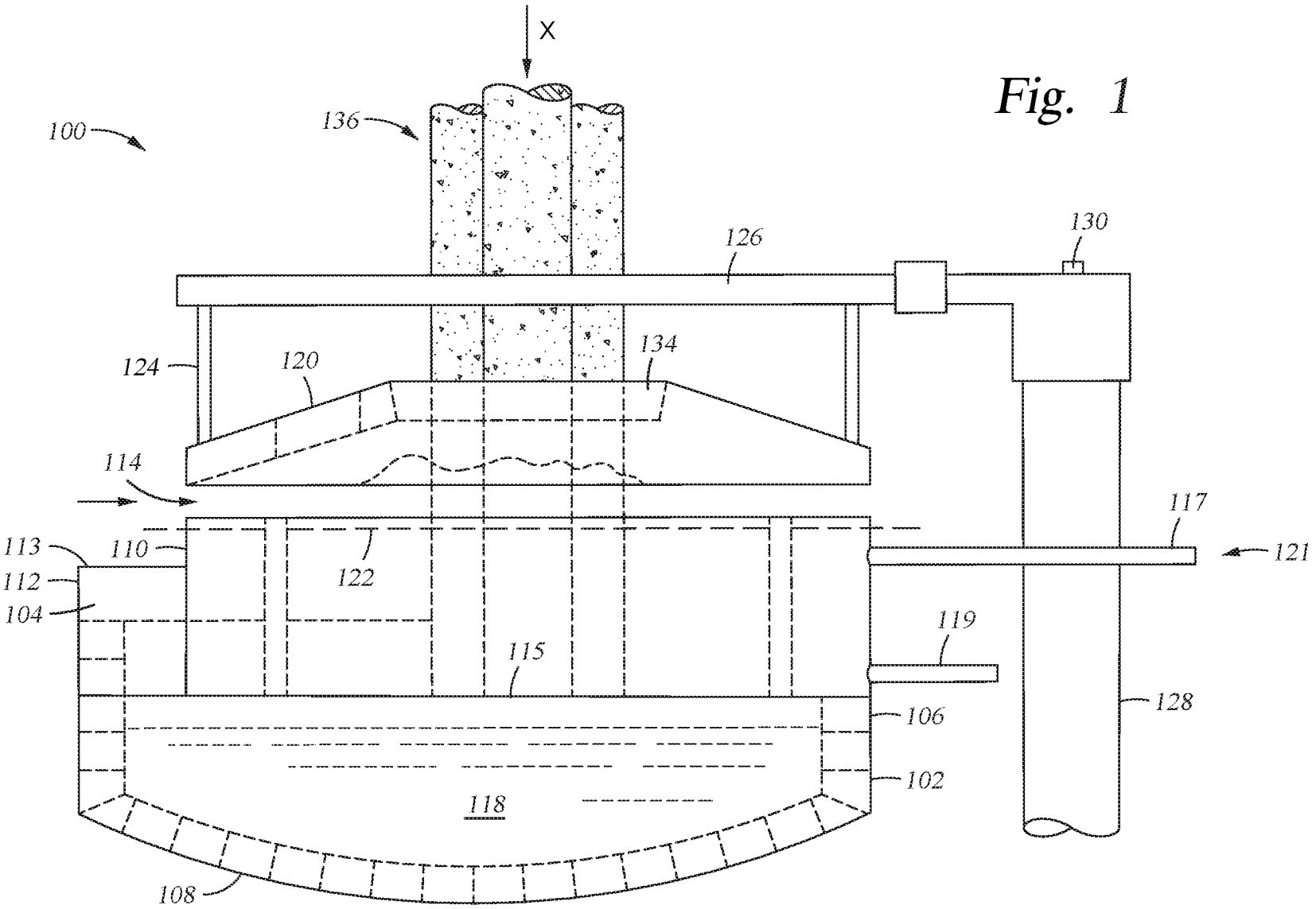
FIG. 1 illustrates an elevational side view of a metallurgical furnace having a spray-cooled roof.

FIG. 1 illustrates an elevational side view of one example of a metallurgical furnace 100. The metallurgical furnace 100 has a body 102 and a roof 120. The roof 120 is supported on a sidewall 110 of the body 102. The body 102 may be generally cylindrical in shape and have an elliptical bottom. The body 102 additionally includes a step-up 104 to the tap side that extends outward from a main cylindrical portion of the body 102. The step-up 104 includes an upper sidewall 112 (which can be consider part of the sidewall 110) and a cover 113.

The body 102, including the step-up 104, has a hearth 106 that is lined with refractory brick 108. Sidewalls 110, 112 are disposed on top of the hearth 106. The sidewall 110 has a top flange 114 and a bottom flange 115. The roof 120 is moveably disposed on the top flange 114 of the sidewall 110. The bottom flange 115 of the sidewall 110 is removably disposed on the hearth 106.

A spray cooling system 121 is utilized to control the temperature of sidewall 110. The spray cooling system 121 has an input cooling port 117 for introducing coolant into the sidewall 110 and a drain port 119 for emptying spent coolant from the sidewall 110. Further details of the spray cooling system 121 are discussed further below.

The sidewall 110 of the body 102 generally surrounds an interior volume 116 (shown in FIG. 2) of the metallurgical furnace 100. The interior volume 116, illustrated in greater detail in FIG. 2, may be loaded or charged with metal, scrap metal, or other meltable material which is to be melted within the hearth 106 of the metallurgical furnace 100 to generate molten material 118.

The metallurgical furnace 100, including the body 102 and the roof 120, is rotatable along a tilt axis 122 about which the metallurgical furnace 100 can tilt. The metallurgical furnace 100 may be tilted in a first direction about the tilt axis 122 toward the slag door (not shown) multiple times during a single batch melting process, sometimes referred to as a "heat", to remove slag. Similarly, the metallurgical furnace 100 may be tilted in a second direction about the tilt axis 122 towards a tap spout (not shown) multiple times during a single batch melting process including one final time to remove the molten material 118.

Roof lift members 124 may be attached at a first end to the roof 120. The roof lift members 124 may by chains, cables, ridged supports, or other suitable mechanisms for supporting the roof 120. The roof lift members 124 may be attached at a second end to one or more mast arms 126. The mast arms 126 extend horizontally and spread outward from a mast support 128. The mast support 128 may be supported by a mast post 130. The mast support 128 may rotate about the mast post 130. Alternately, the mast post 130 may rotate with the mast support 128 for moving the roof lift members 124. In yet other examples, roof lift members 124 may be aerially supported to move the roof 120. In one embodiment, the roof 120 is configured to swing or lift away from the sidewall 110. The roof 120 is lifted away from the sidewall 110 to expose the interior volume 116 of the metallurgical furnace 100 through the top flange 114 of the sidewall 110 for loading material therein.

The roof 120 may be circular in shape. A central opening 134 may be formed through the roof 120. Electrodes 136 extend through the central opening 134 from a position above the roof 120 into the interior volume 116. During operation of the metallurgical furnace 100, the electrodes 136 are lowered through the central opening 134 into the interior volume 116 of the metallurgical furnace 100 to provide electric arc-generated heat to melt the molten material 118. The roof 120 may further include an exhaust port to permit removal of fumes generated within the interior volume 116 of the metallurgical furnace 100 during operation.

Figure 2:
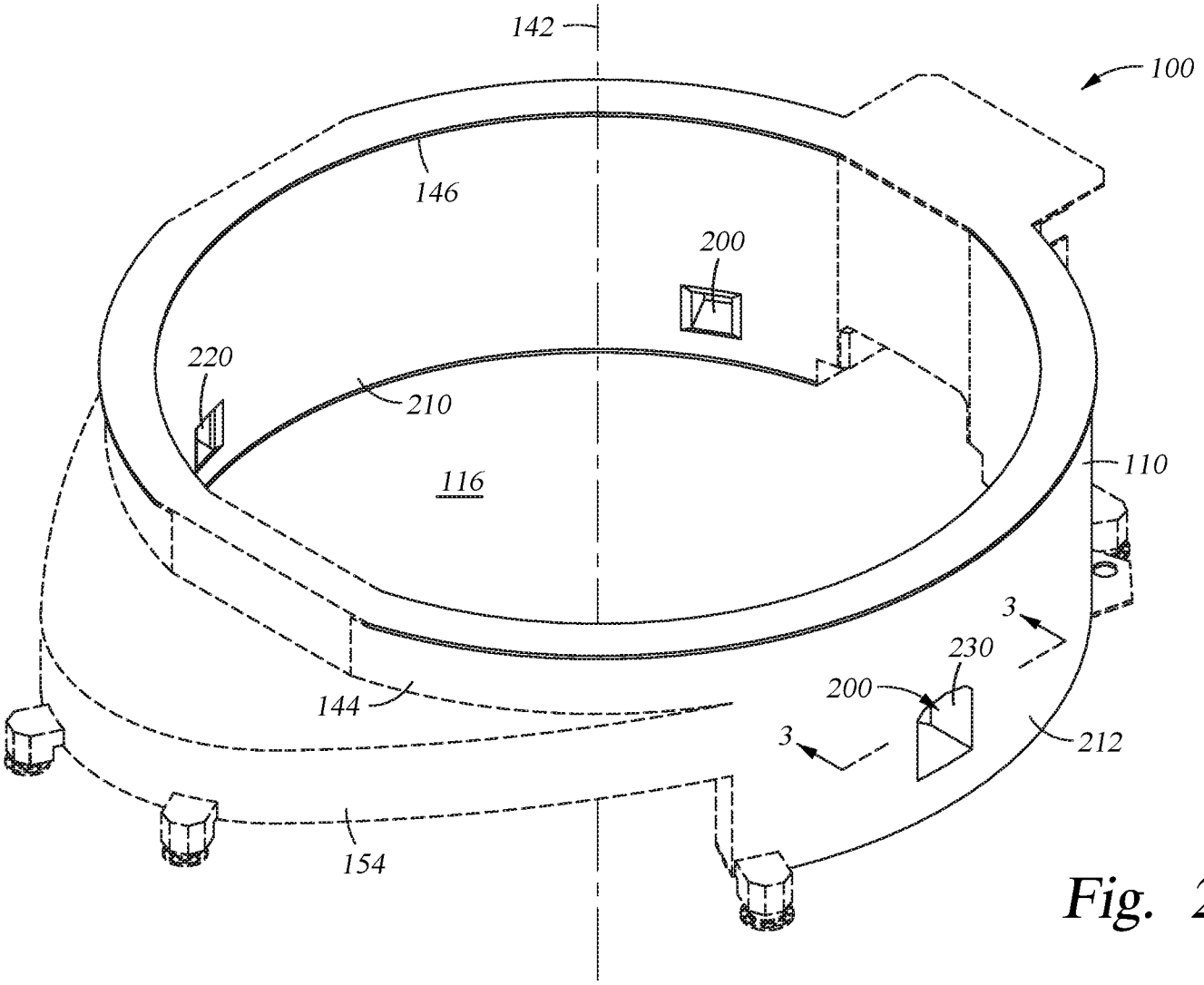
FIG. 2 illustrates a top orthogonal view of the sidewall having a spray cooled system therein of the metallurgical furnace of FIG. 1.

FIG. 2 illustrates a top perspective view of the metallurgical furnace 100 with the roof 120 removed. Referring to FIGS. 1 and 2, the sidewall 110 of the metallurgical furnace 100 has an outer wall 212 and an inner wall 210. The inner wall 210 includes a plurality of hot plates 146. The outer wall 212 has a plurality of dust covers 144 spaced outward of the hot plate 146 relative to a center axis 142 of the body 102. The side of the hot plate 146 facing away from the outer wall 212 and towards the center axis 142 is exposed to the interior volume 116 of the metallurgical furnace 100. In one example, the hot plate 146 is concentric with the dust covers 144 about the center axis 142 of the body 102.

A plurality of tall buckstays (not shown) are distributed between the outer wall 212 and the inner wall 210. The buckstays separate the hot plates 146 in the inner wall 210 from the dust covers 144 in the outer wall 212 of the metallurgical furnace 100. A second plurality of short buckstays (not shown) is distributed about a short outer wall 154 of the step-up 104 to the hot plate 146 of the sidewall 110 of the metallurgical furnace 100. The buckstays significantly increase the buckling resistance of the sidewall 110, thereby allowing the roof 120 to be safely supported by the body 102.

Figure 3:
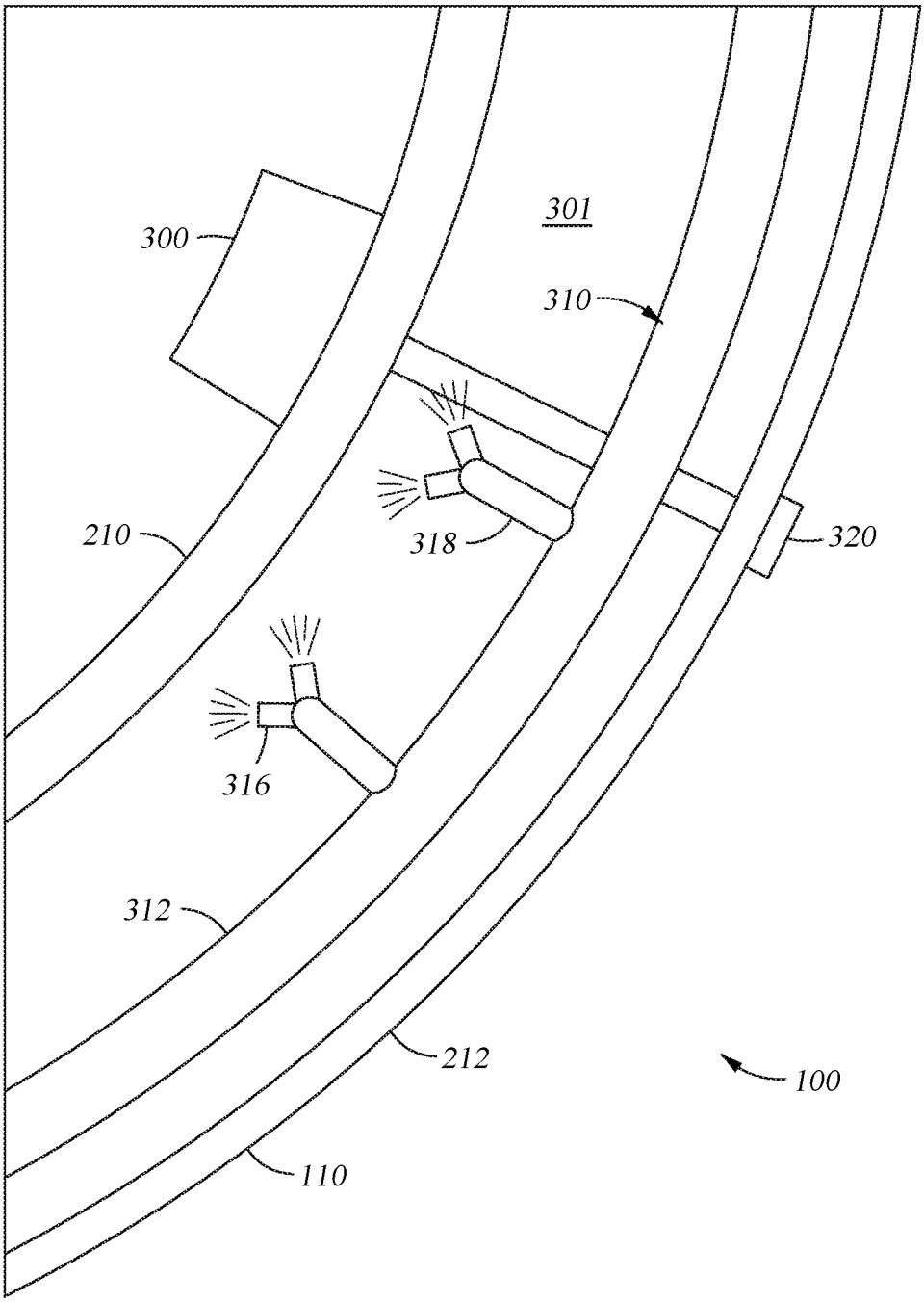
FIG. 3 illustrates a cross-sectional view taken through section line 3-3 of FIG. 2, showing two hollow metal sidewall sections and the spray-cooled system internal thereto.

Additionally turning to FIG. 3, FIG. 3 illustrates a cross-sectional view taken through section line 3-3 of FIG. 2 and showing a section of the inner wall 210 and the outer wall 212. The inner wall 210 and the outer wall 212 surround an interior space 301. A spray cooled system 310 is disposed in the interior space 301 of the sidewall 110.

The sidewall 110 additionally has one or more sidewall burner pockets 200. The burner hole 200 extending through the sidewall 110 has an interior opening 220 in the inner wall 210 and an exterior opening 230 in the outer wall 212. The interior opening 220 receives a burner panel 300 which sealing engages to the inner wall 210. The burner panel 300 may additionally seal to the outer wall 212. For example, an exterior portion 320 of the burner panel 300, such as a shroud or flange, is welded to the outer wall 212.

The spray cooled system 310 has a header pipe 312. A plurality of spray bars 318 are fluidly coupled to the header pipe 312. The spray bars 318 have one or more spray nozzles 316. The spray nozzles 316 are configured to spray a prescribed amount of water or other cooling fluid into the interior space 301 for cooling the sidewall 110 during furnace operations. In one embodiment, the spray cooled system 310 sprays cooling water on portions of the burner panel 300 accessible from the interior space 301 of the sidewall 110.

Figure 4A:
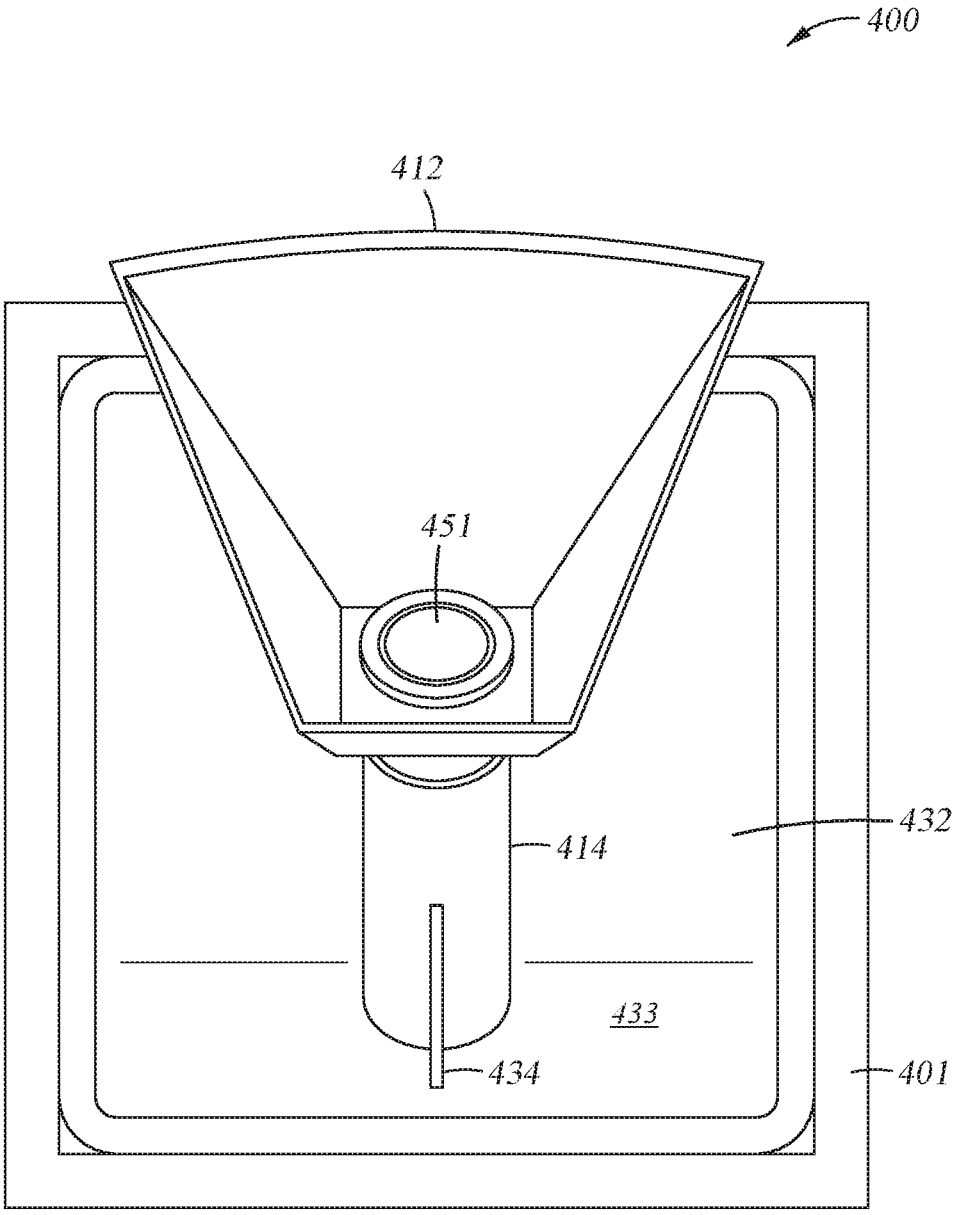
FIG. 4A illustrates a rear elevation view for one embodiment of a burner panel suitable for the sidewall of the metallurgical furnace of FIG. 2.
Figure 4B:
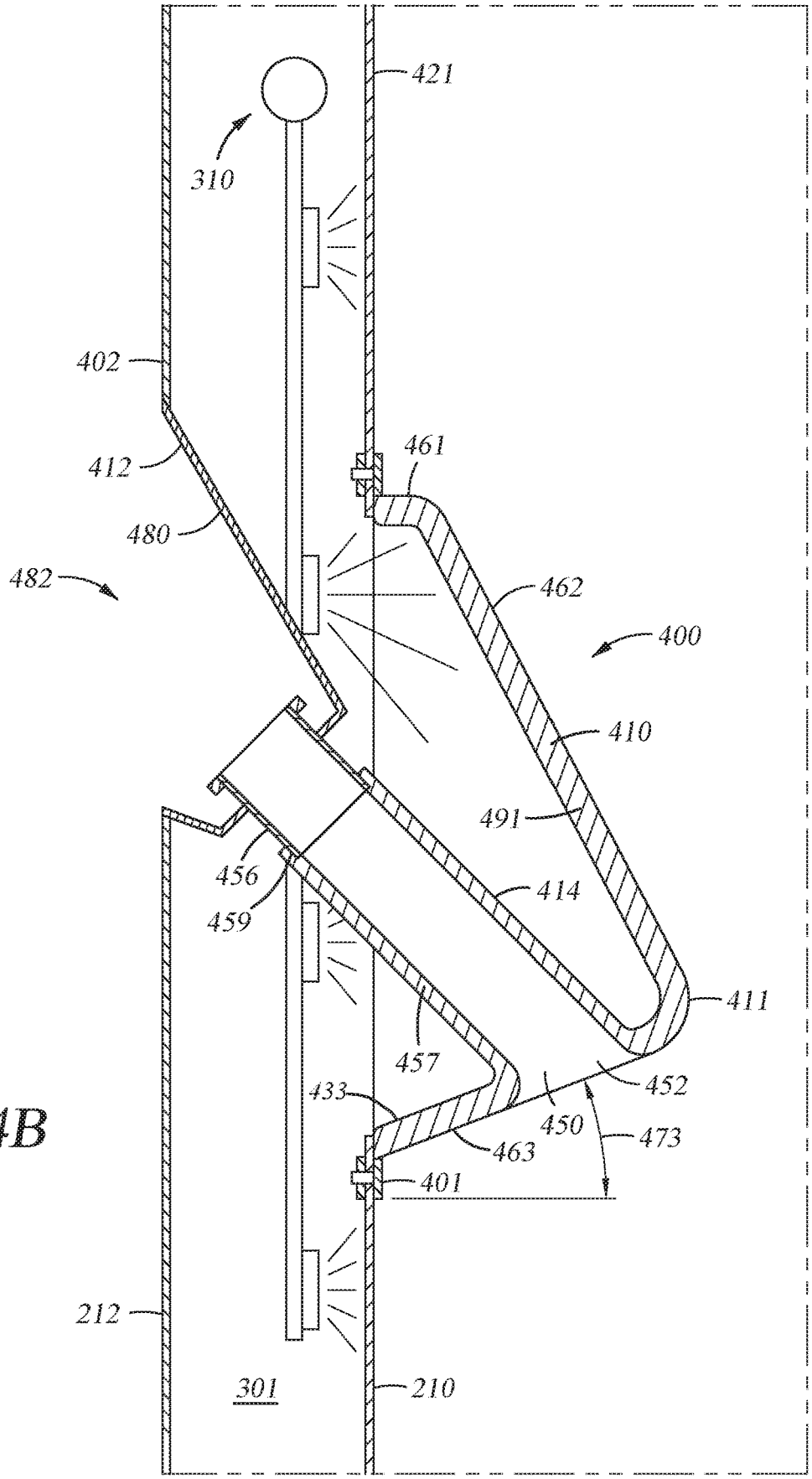
FIG. 4B illustrates a cross-sectional view for the burner panel of FIG. 4A.

FIG. 4A illustrates a rear elevation view for one embodiment of a burner panel 400 suitable for the sidewall 110 of the metallurgical furnace of FIG. 2. FIG. 4B illustrates a cross-sectional view for the burner panel of FIG. 4A. It should be appreciated that the burner panel 400 is but one embodiment of the burner panel 300 shown in FIG. 3 and that further embodiments are discussed below. The burner panel 400 will be discussed with respect to both FIGS. 4A and 4B together.

The burner panel 400 has a body 410. The burner panel 400 additionally has an interior mounting flange 401 surrounding the body 410. The interior mounting flange 401 may be formed from steel or other suitable material. The body 410 is formed from copper or other material having high thermally conductivity. In one embodiment, the flange 401 is formed from steel and cast into the copper body 410. The interior mounting flange 401 has a plurality of through holes configured to accept a coupling 499 for mounting the burner panel 400 to the sidewall 110. It should be appreciated that the depiction of the interior mounting flange 401 as shown in FIGS. 4A-4B and 5A-5B may be further modified or outright changed to accommodate the method of mounting described in FIGS. 6 through 10. Thus, the description of the interior mounting flange 401 discussed below with respect to FIGS. 6 through 10 is to be treated as further embodiments of the interior mounting flange 401 suitable for incorporation into each of the embodiments of the burner panels 400, 500 discussed with respect to FIGS. 4A-4B and 5A-5B.

The body 410 has a burner tube 450 extending therethrough. The body 410 may be void of cooling pipes, other holes or other cavities. The body 410 has an interior portion 411, an exterior portion 412 and a middle portion 414. The interior portion 411 is coupled to the inner wall 210 and exposed to the interior volume 116 of the metallurgical furnace 100. The exterior portion 412 is coupled to the outer wall 212 and exposed to the outside of the metallurgical furnace 100. The middle portion 414 is exposed to the interior space 301 between the inner wall 210 and the outer wall 212. The middle portion 414 is of less material than the interior portion 411 such that a cross-section of the middle portion is smaller than that of the interior portion 411. The middle portion 414 is additionally exposed to the cooling provided by the spray cooled system 310. This allows the burner panel 400 to operate without a separately connected cooling system.

The burner tube 450 has an entrance 451 and an exit 452. The burner tube 450 extends from the interior portion 411, through the middle portion 414, to the exterior portion 412 of the body. The burner tube 450 is configured to accept a burner extending from the outer wall 212 of the sidewall 110 therethrough into the interior volume 116 of the metallurgical furnace 100. The burner tube 450 may have a first section 457 and a second section 456. Alternately, the burner tube 450 may be formed in a continuous section. The first section 457 may be formed of copper or other suitable material. The second section 456 is coupled to the first section 457. For example, the second section 456 may be welded, press fit, slid therein or attached through other suitable techniques. The second section 456 may be formed from carbon steel, stainless steel or other suitable material. In one embodiment, the second section 456 extends through the first section 457 to the exit 452 of the burner tube 450 to protect the burner panel 400. In another embodiment, the second section 456 coupled to an end 459 of the first section 457 opposite the exit 452 of the burner tube 450. In yet other embodiments, it is also contemplated that the second section 456 extends into the first section 457 beyond the end 459, but not to the exit 452 of the burner tube 450. The burner tube 450 is sealed against the interior space 301 such that the cooling fluid from the spray cooled system 310 does not enter into the burner tube 450. One or more gussets 434 may be provided to support the burner tube 450 through the middle portion 414.

The body 410 has a shroud 480 extending along the exterior portion 412 of the body 410. The shroud 480 is coupled to the burner tube 450. The shroud 480 surrounds the entrance 451 of the burner tube 450 extends and is attached to the outer wall 212. The shroud 480 has an enclosure 482 (recess) where the connections to the burner disposed through the burner tube 450 are made exterior to the sidewall 110. The cooling water is sprayed behind the shroud 480 in the interior space 301 of the sidewall 110, i.e., between the inner wall 210 and the outer wall 212. The portions of the body 410 exposed within the interior space 301 are sprayed cooled to prevent the body 410 from overheating. The cooling system sprays both the sidewall 110 and body 410 of the burner panel 400.

The interior portion 411 of the body 410 has a substantially triangular profile (bump) 460 which extends from an exposed surface 421 of the inner wall 210. For example, the bump 460 may extend along a flat surface 461 from the interior mounting flange 401. The flat surface 461 may be substantially perpendicular to the interior mounting flange 401. The bump 460 has an inward sloping section 462 which extends down and away from the interior mounting flange 401 further into the interior volume 116 of the metallurgical furnace 100. A plurality of slag retaining depressions 491 to aid in slag retention is disposed on the surfaces of the body 410 exposed to the interior volume 116 of the metallurgical furnace 100. In one example, the slag retainers 491 are disposed on sloping section 462 of the burner panel 400. An outward sloping surface 463 is coupled to the inward sloping section 462. The outward sloping surface 463 extends further down and back to the interior mounting flange 401. The burner tube 450 is disposed through the outward sloping section 463. The outward sloping section may be angles 473 between about 0 degrees and about 45 degrees from the interior mounting flange 401. The bump 460 provides protection for the burner in the burner panel 400 from being damaged due to material being dropped into the metallurgical furnace 100.

A hollow 432 along the middle portion 414 of the burner panel 400 has a sloped bottom 433 configured to aid the drainage of coolant sprayed there against the middle portion of the burner panel 400 interior to the sidewall 110. The hollow 432 additionally and significantly aids in the weight reduction of the burner panel 400 over convention burner panels.

In addition to the interior mounting flange 401, the burner panel 400 may additionally have an exterior mounting flange 402. The exterior mounting flange 402 may be formed from steel or other suitable material. Conventional burner panels are mechanically fixed to the sidewall 110 with thermal insulation to ensure fluids, such as coolant and molten metal, do not escape their respective spaces or mix. The interior mounting flange 401, and the exterior mounting flange 402, overlaps a portion of the sidewall 110. The interior mounting flange 401 is compressed thereto the sidewall 110 by a fixing technique to secure and make a fluid tight seal between the burner panel 400 with the sidewall 110. The burner panel 400 is mounted by the interior mounting flange 401 and optionally by the exterior mounting flange 402 to the sidewall 110 through a number of suitable techniques of which a number of them are discussed with respect to FIGS. 6-10 and will be discussed later below after the introduction of a second embodiment of the burner panel 300. In one embodiment, the interior mounting flange 401 is formed from steel and welded to the sidewall 110 to form a fluid tight seal therebetween.

Figure 5A:
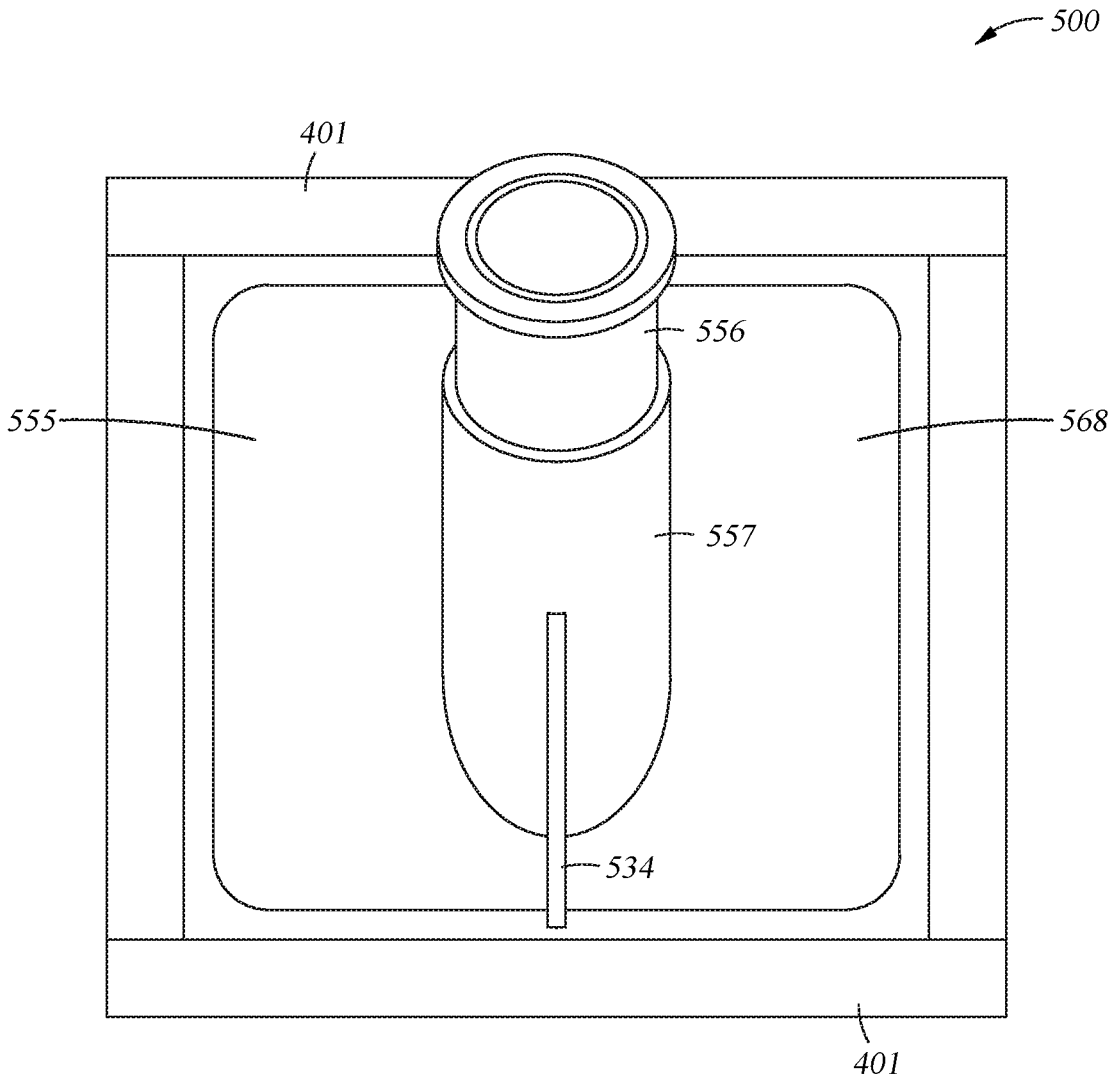
FIG. 5A illustrates a rear elevation view for a second embodiment of a burner panel suitable for the sidewall of the metallurgical furnace of FIG. 2.
Figure 5B:
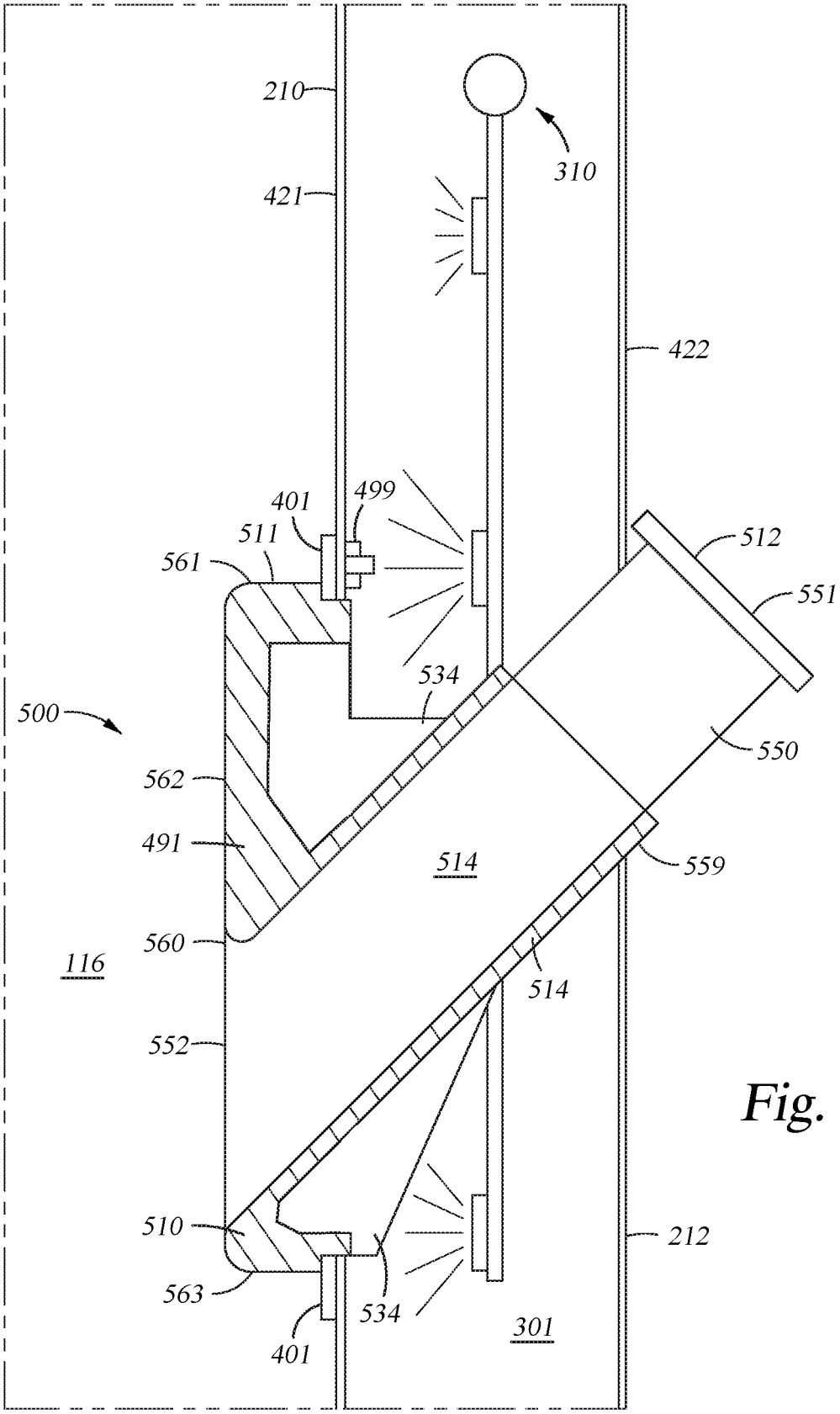
FIG. 5B illustrates a cross-sectional view for the burner panel of FIG. 5A.

FIG. 5A illustrates a rear elevation view for a second embodiment of a burner panel 500 suitable mounting in the sidewall 110 of the metallurgical furnace 100 of FIG. 2. FIG. 5B illustrates a cross-sectional view for the burner panel of FIG. 5A. It should be appreciated that the burner panel 500 is but one embodiment of the burner panel 300 shown in FIG. 3 and that further embodiments may be derived from this disclosure. The burner panel 500 will be discussed with respect to both FIGS. 5A and 5B together.

The burner panel 500 has a body 510. The body 510 may be formed from copper, or other thermally conductive material. The body 510 has a burner tube 550 formed therethrough. The body 510 is void of cooling pipes, holes or other cavities. The body 510 is additionally surrounded by an interior mounting flange 401. The body 510 has an interior portion 511, an exterior portion 512 and a middle portion 514. The interior portion 511 is coupled to the inner wall 210 and exposed to the interior volume 116 of the metallurgical furnace 100. The exterior portion 512 may be coupled to or disposed through the outer wall 212. The exterior portion 512 is exposed to the outside of the metallurgical furnace 100. The middle portion 514 is exposed to the interior space 301 between the inner wall 210 and the outer wall 212. The middle portion 514 is of less material than the interior portion 511 such that a cross-section of the middle portion is smaller than that of the interior portion 511. The middle portion 514 is additionally exposed to the cooling provided by the spray cooled system 310. This allows the burner panel 500 to operate without a separately connected cooling system. That is, the cooling system sprays both the sidewall 110 and body 510 of the burner panel 500.

The burner tube 550 has an entrance 551 and an exit 552. The burner tube 550 extends from the interior portion 511, through the middle portion 514, to the exterior portion 512 of the body 510. The burner tube 550 is configured to accept a burner extending from the outer wall 212 of the sidewall 110 into the interior volume 116 of the metallurgical furnace 100. The burner tube 550 may have a first section 557 and a second section 556. Alternately, the burner tube 550 may be formed in a continuous section. The first section 557 may be unitary to, i.e., part of, the body 510. The first section 557 may be formed of copper or other suitable material. The second section 556 is coupled to the first section 557. For example, the second section 456 may be welded, press fit, slid therein or attached through other suitable techniques. The second section 556 may be formed from carbon steel, stainless steel or other suitable material. In one embodiment, the second section 556 extends through the first section 557 to the exit 552 of the burner tube 550 to protect the burner panel 500. In another embodiment, the second section 556 coupled to an end 559 of the first section 557 opposite the exit 552 of the burner tube 550. In yet other embodiments, it is also contemplated that the second section 556 extends into the first section 557 beyond the end 559 but not to the exit 552 of the burner tube 550. The burner tube 550 is sealed against the interior space 301 such that the cooling fluid sprayed from the spray cooled system 310 does not enter an interior portion of the burner tube 550. A gusset 534 may be provided to support the burner tube 550 through the middle portion 514.

The burner tube 550 has an annulus 555. The annulus 555 surrounds the entrance 551 of the burner tube 550. In one embodiment, burner tube 550 is coupled to the outer wall 212. In another embodiment, burner tube 550 is not coupled to the outer wall 212 and merely extends therethrough. The cooling water is sprayed in the interior space 301 of the sidewall 110, i.e., between the inner wall 210 and the outer wall 212, to maintain the temperature of the burner tube 550.

The interior portion 511 of the body 510 is a substantially flat plate 560 and parallel to the exposed surface 421 of the inner wall 210. For example, interior portion 511 may extend along a first side surface 561 from the interior mounting flange 401. The first side surface 561 may be substantially perpendicular to the interior mounting flange 401. The first side surface 561 extends the thickness of the flat plate 560. The flat plate 560 has a front face 562 which is parallel to the exposed surface 421 of the inner wall 210. Slag retaining depressions 491 which aid in slag retention are disposed on the front face 562 of the burner panel 500. The burner tube 550 is disposed through the front face 562. A second side surface 563 extends between the front face 562 and the interior mounting flange 401.

The burner panel 500 is configured to aid the drainage of coolant sprayed there against the middle portion of the burner panel 500 in the interior to the sidewall 110. The spray cooled system 310 may spray coolant along a backside 568 of the flat plate 560 exposed to the molten material in the metallurgical furnace 100. The burner panel 500 with the spray cooling from the metallurgical furnace 100 can be made with significantly less material than convention burner panels, and therefore weigh and cost significantly less.

The interior mounting flange 401 overlaps a portion of the sidewall 110. The interior mounting flange 401 is compressed thereto the sidewall 110 by a fixing technique to secure and make a fluid tight seal between the burner panel 500 with the sidewall 110. The burner panel 500 may be mounted by the interior mounting flange 401 to the sidewall 110 through a number of suitable techniques of which a number of them are discussed with respect to FIGS. 6 through 10. It should be appreciated that each techniques disclosed below with respect to FIGS. 6 through 10 may modify the mounting flange for the burner panel 300 discussed above and the modifications are alternative embodiments.

Figure 6A:
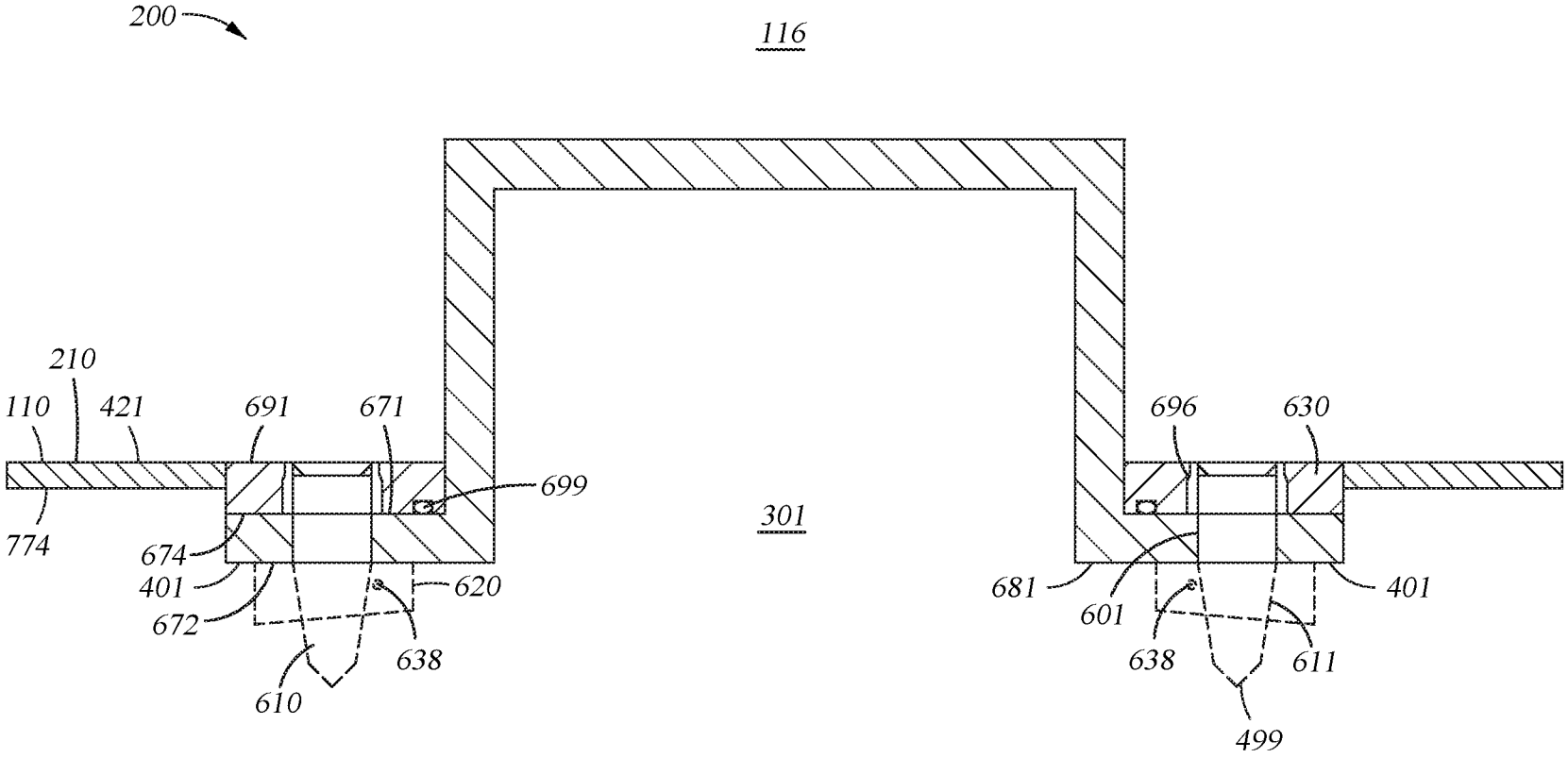
FIG. 6-10 illustrate various embodiments for coupling the burner panel to the sidewall of the metallurgical furnace of FIG. 2.
Figure 6B:
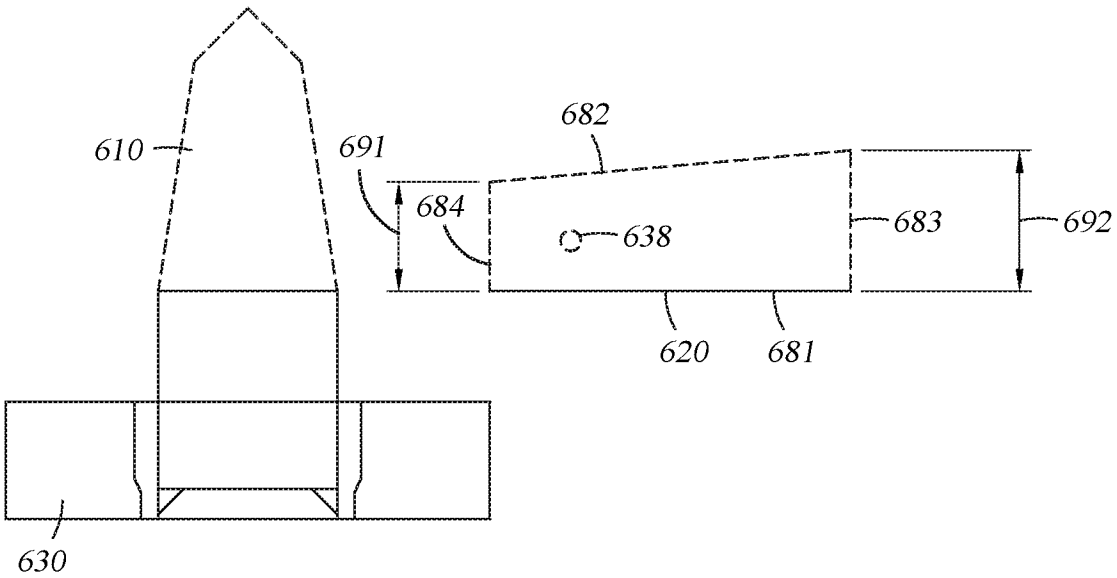

FIG. 6 illustrates one embodiment for coupling the burner panel 300 to the sidewall of the metallurgical furnace of FIG.

2. It should be appreciated that the mounting techniques discussed below apply equally to burner panels 400 and burner panel 500. That is, each burner panel 300 has a substantially similar interior mounting flange 401 in which the techniques below utilize for mounting the burner panel 300.

In the example of FIG. 6, a wedge pin assembly 600 is used for coupling the burner panel 300 to the sidewall 110. The wedge pin assembly 600 has a pin 610 and a wedge 620 which locks in the pin 610. The interior mounting flange 401 of the burner panel 300 has an outer surface 671 and an inner surface 672. The interior mounting flange 401 is additionally equipped with two or more holes 601.

A carbon steel band 630 around the burner panel 300 is configured with the pin 610. The carbon steel band 630 is a wraparound extension of the inner wall 210, i.e., hot plate. The pin 610 is disposed through a hole 696 in the steel band 630. The pin 610 penetrates through a bottom surface 674 of the carbon steel band 630. The pin 610 may be welded, press fit, threaded, have a head that fits in a counter bore, or fixed by other techniques to the carbon steel band 630. The pin 610 has a slot 611 formed therein. The slot 611 configured to accept a wedge 620.

The wedge 620 has first end 684 and a second end 683. The slot has a first side 681 which is substantially perpendicular to both the first end 684 and the second end 683. A second side 682 is disposed between the first end 684 and the second end 683. The second side 682 is not parallel to the first side 681, i.e., at some angle to the first end 684 and the second end 683 which is not 90 degrees. The first end 684 has a first length 691 which is smaller than a second length 692 of the second end 683. The first length 691 is configured to fit into the slot 611 of the pin 610. The second length 692 is configured to not fit into the slot 611 of the pin 610. The wedge 620 may additionally have a fixing instrument 638 for securing the wedge 620 in the slot 611.

The method for securing the burner panel 300 to the inner wall 210 with the wedge pin assembly 600 is as follows. The outer surface 671 of the interior mounting flange 401 is placed against the bottom surface 674 of the carbon steel band 630. The pin 610 protruding from the carbon steel band 630 is aligned and placed through the hole 601 in the interior mounting flange 401. The first side 681 (perpendicular to the ends 683, 684) is placed on the inner surface 672 of the interior mounting flange 401 with the first end 684 aligned with the slot 611 in the pin 610. The first end 684 of the wedge 620 is slid into and penetrates through slot 611. As the wedge 620 is slid into the slot 611, the second side 682 eventually comes into contact with the slot 611 to drive the burner panel 300 against the inner wall 210. The carbon steel band 630 creates a gasket landing for the interior mounting flange 401. For example, a corrugated metal graphite gasket 699 may be disposed therebetween. The wedge 620 is formed from steel and driving the wedge 620 into the slot 611 of the pin 610 compresses the gasket to create a seal. The fixing instrument 638 for securing the wedge 620 in the slot 611 may employ tack welding or other suitable technique to maintain compression and prevent accidental disjoint of the burner panel 300 from the sidewall 110.

Figures 7A, 7B:
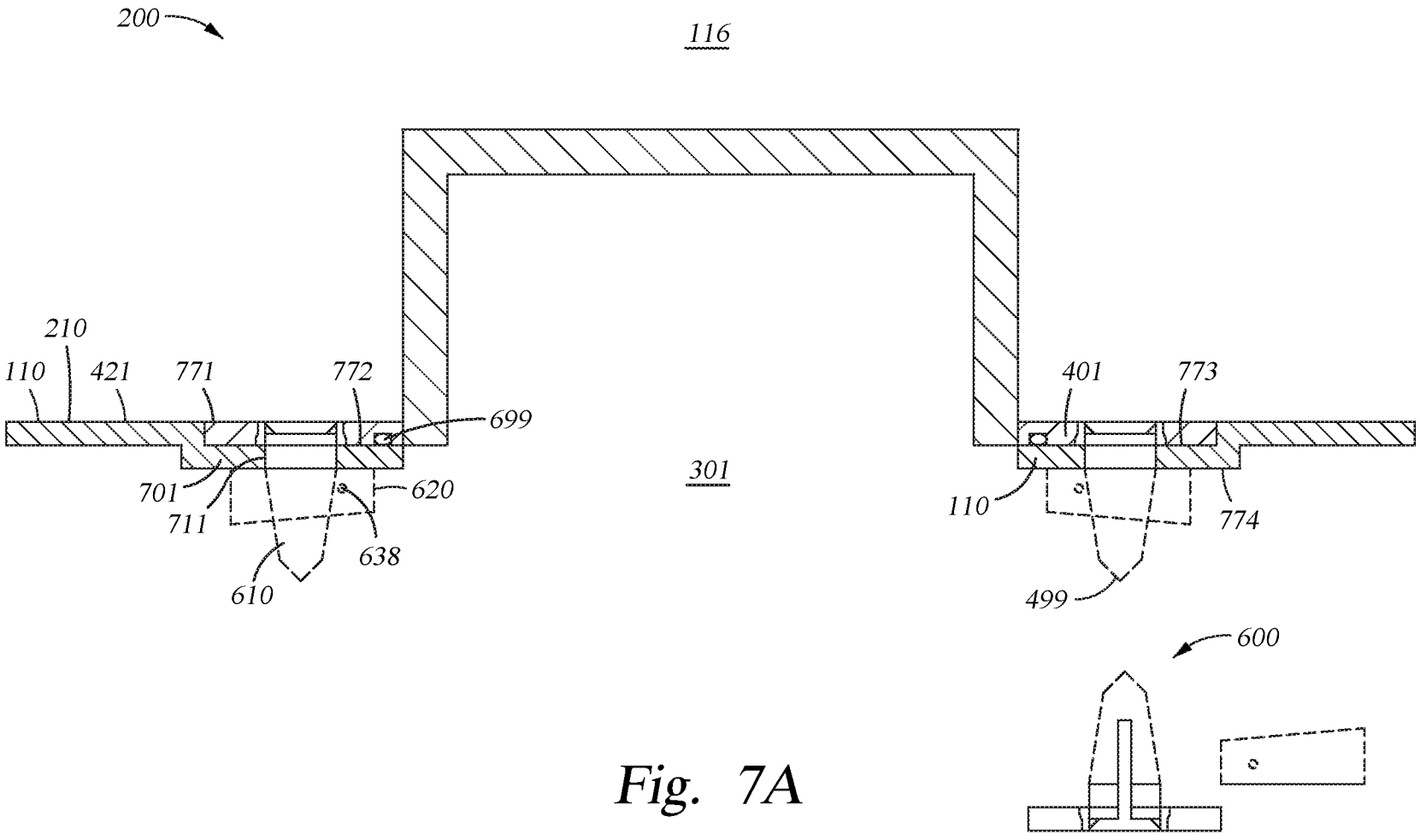

FIG. 7 illustrates another embodiment for coupling the burner panel 300 to the sidewall of the metallurgical furnace of FIG. 2. The features of FIG. 7 and substantially similar to those described above with respect to FIG. 6 except the interior mounting flange 401 of the burner panel 300 is placed on the exposed surface 421 of the inner wall 210.

The pin 610 may be coupled to a hole in the interior mounting flange 401 and penetrate through a bottom surface 772 of the interior mounting flange 401. The pin 610 may be welded, press fit, threaded, have a head that fits in a counter bore, or fixed through other techniques to the interior mounting flange 401. The pin 610 has the slot 611 formed therein configured to accept the wedge 620.

The inner wall 210 optionally have a step 701 therein configured to accept the interior mounting flange 401. The bottom surface 772 of the interior mounting flange 401 is in contact with a top surface 773 of the step 701 in the inner wall 210. In one embodiment, the exposed surface 421 of the inner wall 210 is coplanar with a top surface 771 of the interior mounting flange 401. The step 701 has a hole 711 formed therethrough that is configured to accept the pin 610.

The method for securing the burner panel 300 to the inner wall 210 with the wedge pin assembly 600 is as follows. The bottom surface 772 of the interior mounting flange 401 is placed in the top surface 773 of the step 701 on the exposed surface 421 of the inner wall 210. The pin 610 protruding from the interior mounting flange 401 is aligned and placed through the hole 711 in the step 701 of the inner wall 210. The first side 681 (perpendicular to the ends 683, 684) is placed on the bottom surface 774 of the step 701 with the first end 684 aligned with the slot 611 in the pin 610. The first end 684 of the wedge 620 is slid into and penetrates through slot 611. As the wedge 620 is slid into the slot 611, the second side 682 eventually comes into contact with the slot to drive the burner panel 300 against the step 701 in the inner wall 210. A gasket 699 is provided between the interior mounting flange 401 and the step 701. For example, a corrugated metal graphite gasket (not shown) may be disposed therebetween. The wedge 620 is formed from steel and driving the wedge 620 into the slot 611 of the pin 610 compresses the gasket to create a seal. The fixing instrument 638 for securing the wedge 620 in the slot 611 may by tack welding or other suitable technique to maintain compression and prevent accidental disconnection of the burner panel 300 from the sidewall 110.

Figure 8:
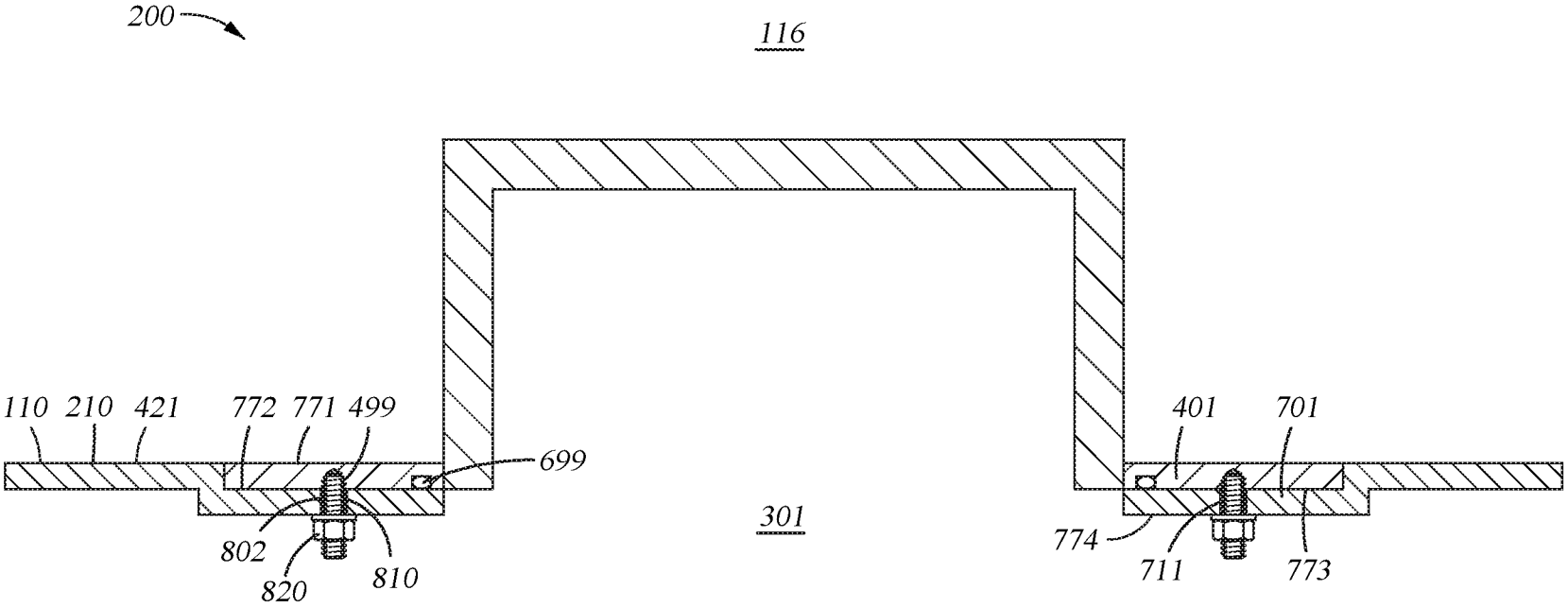

FIG. 8 illustrates yet another embodiment for coupling the burner panel 300 to the sidewall of the metallurgical furnace of FIG. 2. The arrangement of the burner panel 300, flange 401, step 701 and inner wall 210 is substantially similar to that discussed with respect to FIG. 7 above. However, here the wedge pin assembly 600 is replaced with one or more studs 802 and fasteners (nuts) 820.

The interior mounting flange 401 is drilled and tapped to accept the stud 802. Alternately, the stud 802 may be welded to the interior mounting flange 401 or disposed therethrough with a second fastener, similar to fastener 820, disposed on the bottom surface 774 of the step 701. The step 701 has a through hole 810 drilled therethrough and configured to align with the stud 802. The through hole 810 is oversized to allow the stud 802 to move therethrough without binding.

The method for securing the burner panel 300 to the inner wall 210 with the studs 802 and fasteners 820 is as follows. The bottom surface 772 of the interior mounting flange 401 is placed in the top surface 773 of the step 701 on the exposed surface 421 of the inner wall 210. The stud 802 protruding from the interior mounting flange 401 is aligned and placed through the hole 711 in the step 701 of the inner wall 210. The fasteners 820 are placed on studs 802 protruding from the bottom surface 774 of the step 701. Tightening the fasteners 820, i.e., nuts and lock washers, against the bottom surface 774 compress flange 401 of the burner panel 300 against the sidewall 110. A gasket 699 is provided between the interior mounting flange 401 and the step 701. For example, a corrugated metal graphite gasket (not shown) may be disposed therebetween. The tightened fasteners 820 compress the gasket to create a seal, maintain compression, and prevent accidental disconnection of the burner panel 300 from the sidewall 110.

Figure 9:
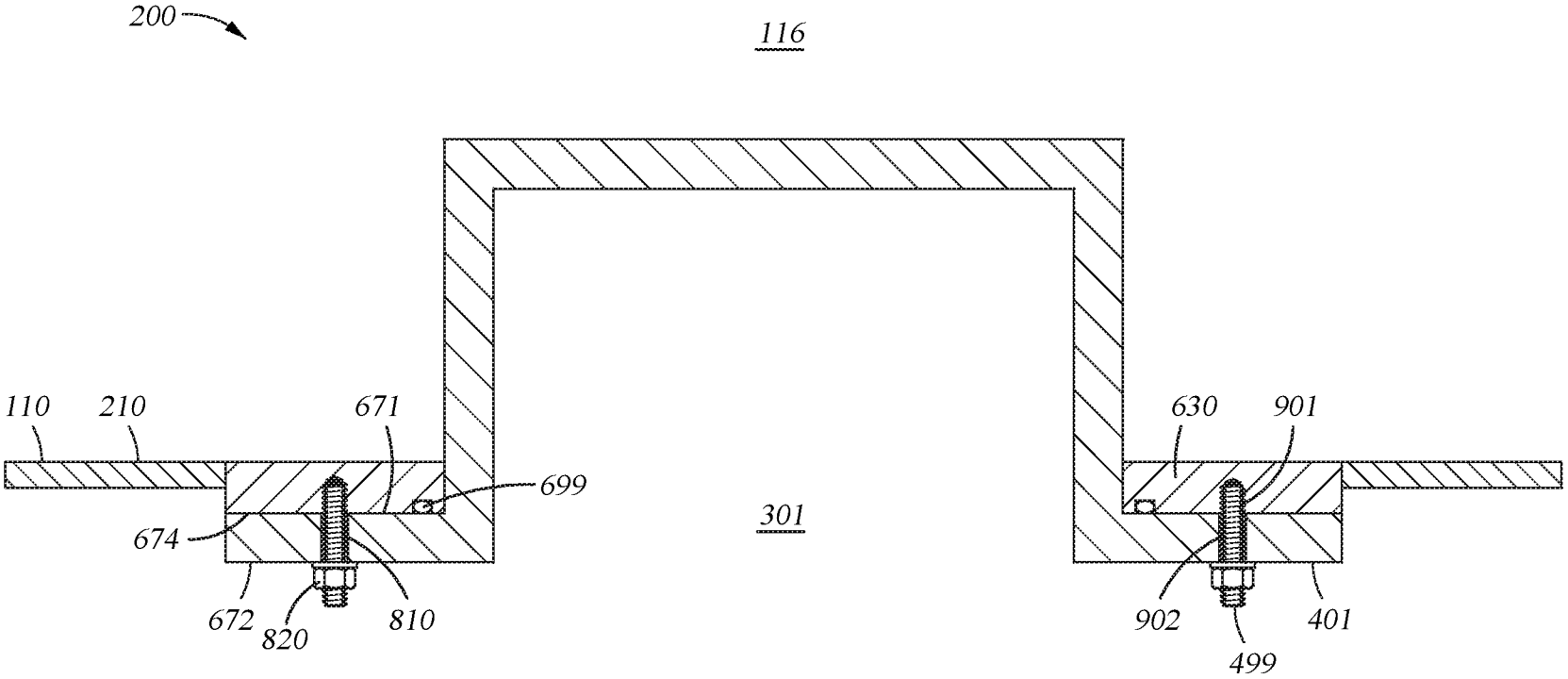

FIG. 9 illustrates yet another embodiment for coupling the burner panel 300 to the sidewall of the metallurgical furnace of FIG. 2. The arrangement of the burner panel 300, flange 401, step 701 and inner wall 210 is substantially similar to that discussed with respect to FIG. 6 above. However, here the wedge pin assembly 600 is replaced with one or more studs 802 and fasteners (nut) 820 as discussed above with respect to FIG. 8.

The carbon steel band 630 has a hole 901 which is drilled and tapped to accept the stud 802. Alternately, the stud 802 may be welded to the carbon steel band 630 or disposed therethrough with a second fastener, similar to fastener 820, disposed on the bottom surface 672 of the mounting flange 401. The interior mounting flange 401 has a through hole 902 drilled therethrough and configured to align with the stud 802. The through hole 902 is oversized to allow the stud 802 to move therethrough without binding.

The method for securing the burner panel 300 to the inner wall 210 with the stud 802 and fastener 820 is as follows. The outer surface 671 of the interior mounting flange 401 is placed against the bottom surface 674 of the carbon steel band 630. The stud 802 protruding from the carbon steel band 630 is aligned and placed through the hole 902 in the interior mounting flange 401. The fasteners 820 are placed on studs 802 protruding from the inner surface 672 of the step flange 401. The carbon steel band 630 creates a gasket landing for the interior mounting flange 401. For example, a corrugated metal graphite gasket (not shown) may be disposed therebetween. Tightening the fasteners 820, i.e., nuts and lock washers, against the inner surface 672 compress flange 401 of the burner panel 300 against the sidewall 110. The tightened fasteners 820 compress the gasket to create a seal, maintain compression and prevent accidental disconnection of the burner panel 300 from the sidewall 110.

Figure 10:
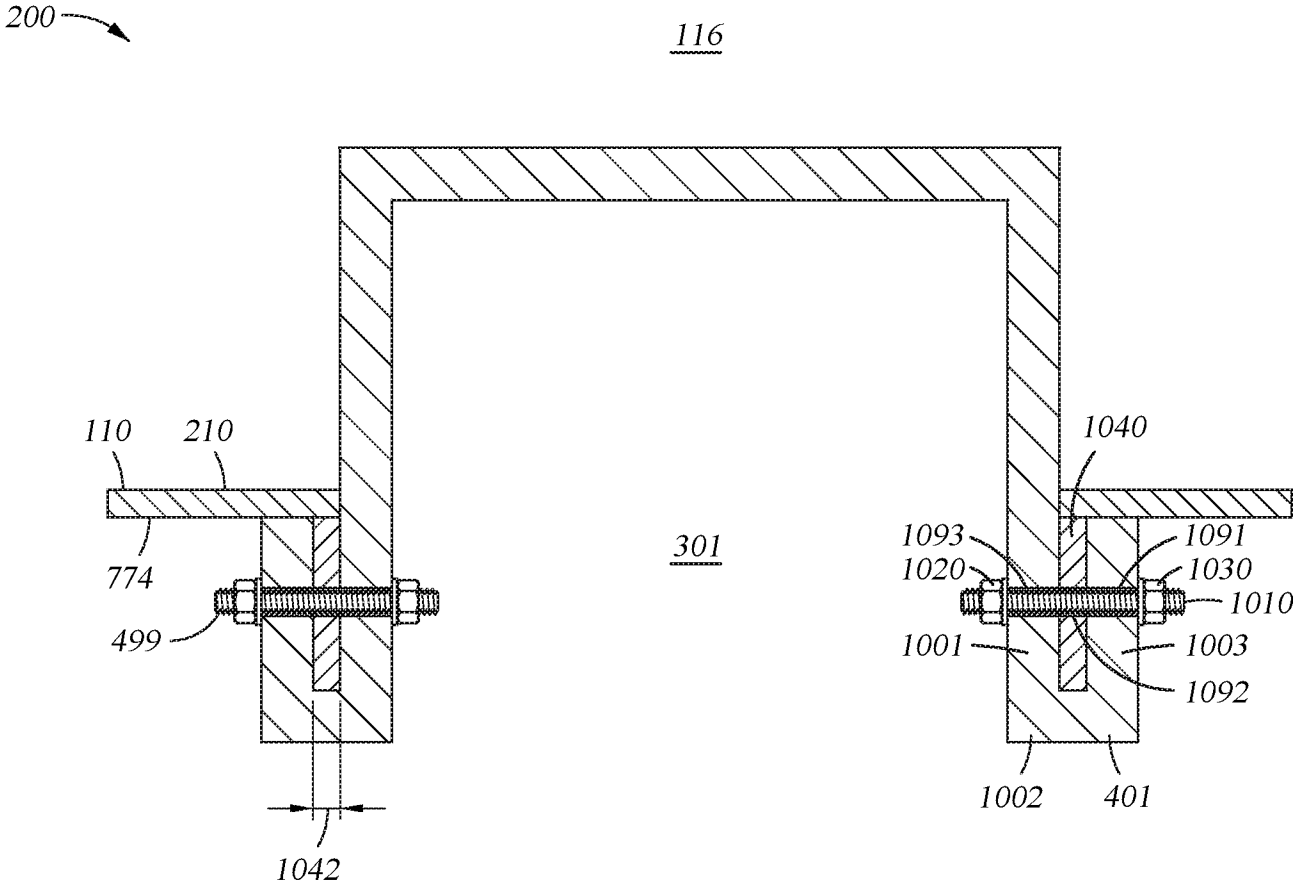

FIG. 10 illustrates yet another embodiment for coupling the burner panel 300 to the sidewall of the metallurgical furnace of FIG. 2. The burner panel 300 is attached to the sidewall with one or more studs 1010 and fasteners (nut) 1020, 1030. It should be appreciated that the stud 1010 may be a carriage bolt or other similar item and only have a single fastener, such as fastener 1030. Likewise, one or more of the fasteners 1020, 1030, may be a carriage bolt head, a nut washer combo, or other device suitable for interfacing with the studs 1010.

The inner wall 210 has an extension 1040. The extension 1040 is perpendicular to the inner wall 210 and extends toward the interior space 301 and away from the inner volume 116 of the metallurgical furnace 100. The extension 1040 may be formed from steel or other suitable material. A through hole 1092 is formed through the extension. The through hole 1092 is sized to permit the stud 1010, bolt or other rod like device, to pass therethrough without binding.

The flange 401 of the burner panel 300 is configured as a CU' shaped channel. The flange 401 has a first section 1001 extending away from the inner wall 210 into the interior space 301, a second section 1002 extending perpendicularly outward from the first section 1001, and a third section 1003 extending perpendicularly from the second section 1002 and towards the inner wall 210. A space 1042 between the first section 1001 and the third section 1003 is sized to accept and the extension 1040 of the inner wall 210. The first section 1001 has a first hole 1093 and the third section 1003 has a second hole 1091. The first hole 1093 and second hole 1091 are linearly aligned. The first hole 1093 and second hole 1091 are sized to permit a stud 1010 to pass therethrough without binding. When the extension 1040 is placed in the space 1042 between the first section 1001 and the third section 1003, the first hole 1093 and second hole 1091 align with the through hole 1092 in the extension 1040.

The method for securing the burner panel 300 to the inner wall 210 with the stud 1010 and fastener 1020, 1030 is as follows. The extension 1040 of the sidewall 110 in placed in between the first section 1001 and third section 1003 of the interior mounting flange 401. The stud 1010 is inserted through the holes 1091, 1092, 1093 such that a portion of the stud 1010 extends beyond both the first section 1001 and third section 1003 of the interior mounting flange 401. The fasteners 1030, 1020 are placed on the studs 1010 and tightened. Here, the seal provided in this method by the extension 1040 and the interior mounting flange 401 is sufficient that a gasket is unnecessary. Tightening the fasteners 1020, 1030, i.e., nuts and lock washers, against the first section 1001 and third section 1003 of the interior mounting flange 401, compress flange 401 against the sidewall 110. The tightened fasteners 1020, 1030 create a seal and maintain compression and prevent accidental disjoint of the burner panel 300 from the sidewall 110.

Advantageously, the burner panels 300, 400 require no additionally external or separate plumbing for cooling the burner panels 300, 400. Additionally the burner panel 300 utilizes substantially less material in the construction thereof reducing costs and the overall weight of the burner panel 300, 400. The method used for coupling the burner panel 300, 400 to the sidewall 110 of the metallurgical furnace 100 allow for quick and easy removal without cutting and welding. Therefore, the change out and repair of the burner panels 300, 400 can be accomplished in a reduced amount of time, with less complexity and cheaper than conventional burner panels without compromising the performance of the burner panel under operational conditions.

While the foregoing is directed to embodiments of the present disclosure, other and further embodiments may be devised without departing from the basic scope thereof, and the scope thereof is determined by the claims that follow.

What is claimed is:

1. A burner panel comprising:

a body having:

an interior face, a hollow extending into the interior face, and a middle portion extending from the hollow toward the interior face, the hollow having a sloped bottom to aid drainage of coolant sprayed against the middle portion;

a burner tube disposed through the middle portion of the body, the burner tube comprising:

a first portion; and a second portion coupled to the first portion; and an internal mounting flange extending along the periphery of the interior face of the body, wherein the body of the burner panel has no internal plumbing for cooling.

2. The burner panel of claim 1 further comprising:

a shroud coupled to and extending from the second portion of the burner tube; and an external flange coupled to the periphery of the shroud.

3. The burner panel of claim 1, wherein the body is formed from copper and the internal mounting flange is formed from steel.

4. The burner panel of claim 1, wherein the internal mounting flange has a plurality of through holes configured to accept a coupling.

5. The burner panel of claim 1, wherein the internal mounting flange has a plurality of pins or studs extending therefrom.

6. The burner panel of claim 1, wherein the internal mounting flange has a gasket disposed thereon.

7. The burner panel of claim 1, wherein the body has a middle portion cross-sectionally smaller than an internal portion having the interior face.

8. A metallurgical furnace comprising:

a sidewall having a roof disposed thereon, the sidewall comprising:

an interior face having a first surface surrounding an interior volume and a second surface facing away from the interior volume, the interior face having a sidewall burner pockets formed therethrough;

a burner panel disposed in the sidewall burner pockets, the burner panel comprising:

a body having:

an interior face, a hollow extending into the interior face, and a middle portion extending from the hollow toward the interior face, the hollow having a sloped bottom to aid drainage of coolant sprayed against the middle portion;

a burner tube disposed through the middle portion of the body, the burner tube configured to receive a burner; and a spray cooling system comprising:

a header;

a first nozzle coupled to the header and positioned to spray coolant onto the second surface of the sidewall; and a second nozzle coupled to the header and positioned to spray coolant onto the body of the burner panel.

9. The metallurgical furnace of claim 8, wherein the burner panel further comprises:

a first portion; and a second portion coupled to the first portion; and an internal mounting flange extending along the periphery of the body and overlapping the sidewall, the sidewall and internal mounting flange compressed together by a coupling.

10. The burner panel of claim 9, wherein the burner panel further comprises:

a shroud coupled to and extending from the second portion of the burner tube; and an external flange coupled to the periphery of the shroud.

11. The burner panel of claim 9, wherein the internal mounting flange has a plurality of pins or studs extending therefrom.

12. The burner panel of claim 11, wherein a gasket makes a seal between the internal mounting flange and the sidewall.

13. The burner panel of claim 11, wherein the pins or studs compresses the internal mounting flange against the interior face.

14. A method for securing a burner panel to a metallurgical furnace, the method comprising:

placing a mounting flange of a burner panel over a sidewall of the metallurgical furnace; and compressing the flange and wall together to form a fluid seal therebetween.

15. The method of claim 14 further comprising:

jamming a wedge through a slot in a pin extending from the flange through a hole in the sidewall, wherein the wedge is disposed against the sidewall.

16. The method of claim 14 further comprising:

jamming a wedge through a slot in a pin extending from the sidewall through a hole in the flange, wherein the wedge is disposed against the flange.

17. The method of claim 14 further comprising:

tightening a fastener to a stud extending from the sidewall through a hole in the flange, wherein the fastener is disposed against the flange.

18. The method of claim 14 further comprising:

tightening a fastener to a stud extending from the flange through a hole in the sidewall, wherein the fastener is disposed against the sidewall.

19. The method of claim 14 further comprising:

compressing an extension of the sidewall in a CU' shaped portion of the flange with a fastener applied to a stud.

20. The burner panel of claim 10, wherein the body of the burner panel is formed from copper and the internal mounting flange is formed from steel.

* * * * *